United States Patent [19]

Lusk

[11] 4,198,538

[45] Apr. 15, 1980

[54] SUSPENSION INSULATOR

[75] Inventor: George E. Lusk, Woodstock, Ill.

[73] Assignee: Josyln Mfg. and Supply Co., Chicago, Ill.

[21] Appl. No.: 909,679

[22] Filed: May 25, 1978

Related U.S. Application Data

[63] Continuation-in-part of Ser. No. 667,106, Mar. 15, 1976, abandoned.

[51] Int. Cl.[2] ..... H01B 17/02; H01B 17/44

[52] U.S. Cl. ..... 174/140 S; 29/631; 174/149 R; 174/179

[58] Field of Search ..... 174/140 R, 140 S, 141 R, 174/148, 149 R, 150, 176, 177, 178, 179, 186, 209; 29/631

[56] References Cited

U.S. PATENT DOCUMENTS

| | | | |
|---|---|---|---|
| 1,194,957 | 8/1916 | Cochrane | 174/179 |
| 1,502,829 | 7/1924 | Kempton | 174/178 |
| 3,134,164 | 5/1964 | Hocks | 174/179 X |
| 3,549,791 | 12/1970 | Yonkers | 174/179 |

FOREIGN PATENT DOCUMENTS

| | | | |
|---|---|---|---|
| 1097222 | 2/1955 | France | 174/179 |
| 1234852 | 5/1960 | France | 174/179 |
| 68266 | 8/1969 | German Democratic Rep. | 174/149 R |
| 878073 | 9/1961 | United Kingdom | 174/179 |
| 983526 | 2/1965 | United Kingdom | 174/179 |
| 1224626 | 3/1971 | United Kingdom | 174/179 |

*Primary Examiner*—Laramie E. Askin

*Attorney, Agent, or Firm*—Mason, Kolehmainen, Rathburn & Wyss

[57] ABSTRACT

A suspension insulator for supporting a high voltage power cable suspended from a transmission tower includes an elongated rod for supporting a load in tension, a plurality of insulating shells serially disposed along the rod and end connectors for attaching a high tension load to the rod. At least one of the end connectors includes an elongated metal cylindrical retainer having one or more metallic members with one or more inclined surfaces disposed within the retainer and circumferentially disposed around the rod. The space between the inclined surface or surfaces and the rod is filled by an epoxy resin compound.

In order to prevent excessive heating of the compound due to external flashover of the suspension insulator and the possible resultant separation of the end connector from the rod, the suspension insulator includes a generally cylindrically shaped, electrically conductive, current bypass sleeve disposed about the retainer to provide a current path physically remote from the epoxy resin compound.

Compensation members are provided between adjacent serially disposed insulating elements of the suspension insulator to provide for thermally induced volumetric changes within the suspension insulator. The compensation members are fabricated from a closed cell, compressible material.

The suspension insulation further includes an annularly shaped corona shield serially disposed between the current bypass sleeve and the closest insulating shell to reduce the occurrence of radio frequency interference.

The suspension insulator in one arrangement includes an elongated, shedless, ceramic insulating sleeve for reducing radio frequency interference when the suspension insulator is arranged with another suspension insulator in a "V" configuration for supporting a plurality of high voltage power cables suspended from a transmission tower.

22 Claims, 3 Drawing Figures

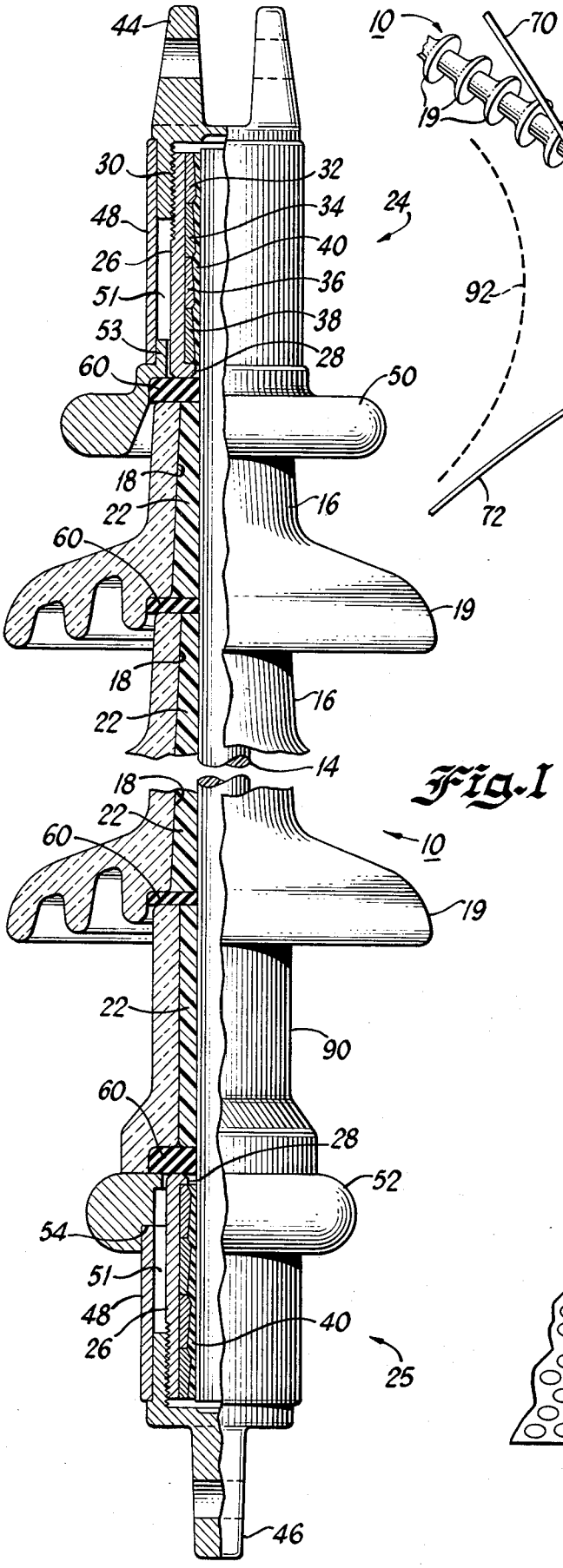
Fig. 1
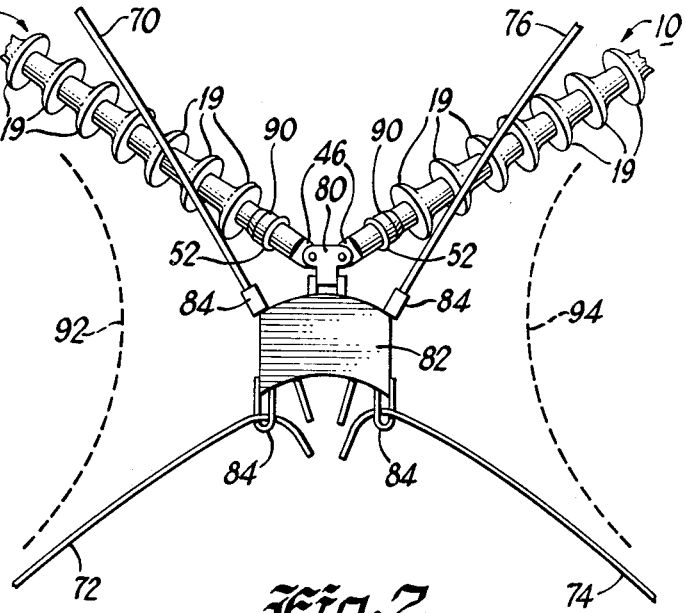
Fig. 2
Fig. 3
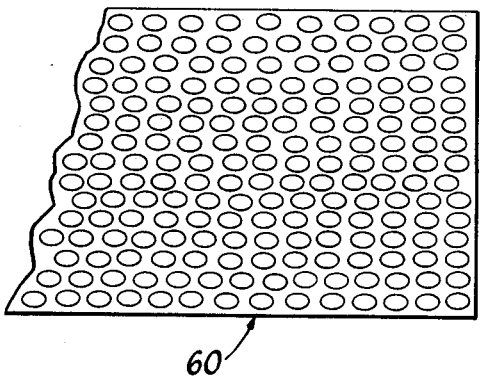

SUSPENSION INSULATOR

CROSS-REFERENCE TO RELATED APPLICATIONS

This application is a continuation in part of co-pending application Ser. No. 667,106 filed on Mar. 15, 1976, now abandoned, and is directed to an improvement in a suspension insulator first disclosed in co-pending application Ser. No. 576,731 filed on May 12, 1975. That co-pending application Ser. No. 576,731 is hereby incorporated by reference to this application for all purposes.

BACKGROUND OF THE INVENTION

A. Field of the Invention

The device of the present invention generally relates to the art of suspension insulators and more particularly to a new and improved suspension insulator for very high voltage application that is designed to provide more reliable performance over a wide temperature range.

B. Description of the Prior Art

Suspension insulators for supporting high voltage power cables suspended from high transmission towers are old and well known in the art. The above-identified co-pending application Ser. No. 576,731 discloses and claims a new and improved suspension insulator and more particularly a new and improved end connector for a suspension insulator. The end connector disclosed in the above-identified copending application includes an epoxy resin compound filling the space between inclined metallic surfaces of the end connector and an elongated rod used to support a load in tension. Where a suspension insulator is subjected to a very wide temperature range and/or for very high voltage applications where external flashovers may generate high current flows and the resultant large amounts of heat, the mechanical connection between the end connector and the rod through the epoxy resin compound may weaken due to the heating of the epoxy resin compound. Ultimately, the weakening in the bond may result in the separation of the end connector from the rod and the resultant separation of the high voltage power cable from the transmission tower.

The suspension insulator as disclosed in the aforementioned co-pending application includes an end connector arrangement affixed to an elongated rod used to support a load in tension. A plurality of insulating shells are serially disposed along the rod and between the end connectors. The elongated rod for example is a resin bonded, glass reinforced type and the ceramic insulating shells typically are formed from porcelain each having an elongated central bore and an integrally formed radially, outwardly extending skirt or shed. The space between the central bore of each of the shells and the outer periphery of the elongated rod is filled with elastomeric filler material.

When suspension insulators of this general type are exposed to wide ranges of temperature extremes, the coefficient of thermal expansions for the various materials used over these wide temperature ranges can lead to catastrophic failure modes of the suspension insulator and tend to destroy the overall suspension insulator assembly. In part, this is caused by the different coefficients of thermal expansion between the materials and at their interfaces; for example at the various interfaces between the insulating shells, the elongated rod and the filler material between the shells and the rod. In a particular example, the porcelain material of the insulating shells has an expansion coefficient of 2 ppm/°F. and the filler material has an expansion coefficient of 35 ppm/°F. Further, the material of the elongated rod has an expansion coefficient of approximately 2.5 ppm/°F. in the longitudinal direction and approximately 20 ppm/°F. in the radial direction. Thus, it is apparent that the filler material expands more than its interfacing restraining surfaces, namely the procelain insulating shells and the elongated, glass reinforced rod.

Further, the volumetric changes experienced by the various component parts of the suspension insulator due to thermal expansion and contractions of the elements also increases hermetic sealing problems that allow the ingress of moisture and contaminants leading to potential break down conditions and failure of the suspension insulator.

In the aforementioned co-pending application Ser. No. 576,731 and in U.S. Pat. No. 3,549,791 which issued to E. H. Yonkers on Dec. 22, 1970, there is disclosed an arrangement for maintaining the integrity of the interfaces between the elongated rod and the filler and also the filler and the insulating shells under various operating conditions by compression loading of the shells and the filler material. The compression loading is obtained by providing springs acting between the end fittings and the shells and the filler material.

British Patent Nos. 983,526, to Milligan et al and 878,073 to Proud et al disclose electrical insulator arrangements wherein flexible washers are disposed to separate tubular insulating bodies to maintain a watertight seal during flexing.

While the above-described arrangements are generally suitable for their intended use, the suspension insulators of the prior art do not provide expansion compensation for a suspension insulator due to the differences of thermally induced volumetric changes of the insulating shells, the rod and the filling material without the use of compression loading techniques or springs.

SUMMARY OF THE INVENTION

Accordingly, it is a principal object of the present invention to provide a new and improved suspension insulator.

Another object of the present invention is to provide a new and improved suspension insulator having integral compensation for thermally induced volumetric changes of the internal components of the suspension insulator that avoids one or more of the aforementioned disadvantages of the prior art.

It is another object of the present invention to provide a new and improved suspension insulator with integral compensation for thermally induced volumetric changes between the components of a suspension insulator by the provision of compressible, closed cell compensation discs between serially disposed insulating shells of the suspension insulator.

It is a further object of the present invention to provide an electrically conductive, current bypass arrangement to prevent excessive heating of the potting compound of the end connector of a suspension insulator.

Briefly, the present invention is directed to a new and improved suspension insulator for supporting a high voltage power cable suspended from a transmission tower. The suspension insulator includes an elongated rod for supporting a load in tension, a plurality of insulating shells serially disposed along the rod and end connectors for attaching a high tension load to the rod. The insulating shells are fabricated having an elongated central bore larger than that of the elongated rod and the space between the central bore of each shell and the outer periphery of the rod is filled with an elastomeric filler material. At least one of the end connectors includes a high strength elongated metal cylindrical retainer, a plurality of metal collets or annular rings serially longitudinally disposed within the retainer and about the rod and an epoxy resin potting compound filling the space between the collets and the rod to securely mechanically join the end connector and a load applied thereto in tension to the rod.

The suspension insulator further includes a generally cylindrically shaped, electrically conductive current bypass sleeve disposed about and substantially enclosing the retainer to prevent the excessive heating of the potting compound due to external flashover of the suspension insulator and the possible resultant separation of the end connector from the rod. The suspension insulator further includes an annularly shaped corona shield disposed between the current bypass sleeve and the nearest insulating shell to aid in reducing deleteriousradio frequency interference.

Compensation discs fabricated from a closed cell compressible material are provided between adjacent serially disposed insulating elements of the suspension insulator to substantially hermetically seal the interior portions of the suspension insulator and to provide for thermally induced volumetric changes due to the expansion and contraction of the insulating shells, the elongated rod and the filler material.

Where a plurality of suspension insulators are arranged in a "V" configuration to support a plurality of high voltage power cables suspended from a transmission tower, an elongated, shedless, generally cylindrical ceramic insulator is disposed at the conductor end of the suspension insulator between a corona shield or end connector and the lowermost insulating shell. The elongated shedless insulator spaces the lowermost shell more distant from the end connector and the associated plurality of high voltage power cables to thereby reduce the possibility of the occurrence of arcing to the lowermost shell and radio frequency interference.

BRIEF DESCRIPTION OF THE DRAWINGS

The invention both as to its organization and method of operation together with further objects and advantages thereof will best be understood by reference to the following specification taken in conjunction with the accompanying drawings therein:

FIG. 1 is a fragmentary, partially cross-sectional and partially elevational view of a suspension insulator constructed in accordance with the principles of the present invention;

FIG. 2 is a fragmentary, elevational view of a plurality of suspension insulators constructed in accordance with the principles of the present invention and arranged in a "V" configuration to support a plurality of high voltage power cables suspended from a transmission tower; and FIG. 3 is a fragmentary, enlarged cross-sectional pictorial representation of a compensation disc of the suspension insulator of FIG. 1.

DESCRIPTION OF THE PREFERRED EMBODIMENT

As illustrated in FIG. 1, a new and improved suspension insulator 10 includes an elongated suspension rod 14, preferably of the resin bonded, glass reinforced type, for supporting a load in tension, that is, one or more high voltage power cables suspended from a transmission tower. The suspension insulator 10 further includes a plurality of ceramic insulating shells 16, typically formed from porcelain, each having an elongated central bore 18 and an integrally formed radially outwardly extending skirt or shed 19. The space between the central bore 18 of each shell 16 and the outer periphery of the rod 14 is filled with an elastomeric filler 22.

A pair of end connectors 24 and 25 are respectively disposed at opposite longitudinal ends of the rod 14, that is, the connector 24 is disposed at the tower end of the suspension insulator 10 and the end connector 25 is disposed at the power cable or conductor end of the suspension insulator 10. In accordance with a specific embodiment of the present invention, each of the end connectors 24 and 25 includes a high strength, metal cylindrical retainer 26 having an integrally formed radially inwardly projecting shoulder 28 formed at one longitudinal end of the retainer 26 and a plurality of threads 30 disposed about the outer periphery of the retainer 26 at its opposite longitudinal end. A plurality of metal collets or annular rings 32, 34, 36 and 38, formed in a specific embodiment from aluminum, are serially disposed in a longitudinally extending stack within and along the longitudinal axis of the retainer 26 and about an end of and along the longitudinal axis of the rod 14. The space between the collets 32, 34, 36 and 38 and the outer periphery of the rod 14 is filled with an epoxy resin potting compound 40, the mechanical bonding strength of which is temperature dependent, that is, decreases markedly with increasing temperature. These specific features of the connectors 24 and 25 are fully disclosed in the above-identified copending patent application and reference should be had thereto for more specific details of these features.

The end connector 24 further includes a clevis fitting 44 having a plurality of internal threads for engaging the threads 30 of the retainer 26. The clevis fitting 44 is used to attach the tower end of the suspension insulator 10 to a transmission tower. Similarly, the connector 25 includes a tongue fitting 46 having a plurality of internal threads for engaging the threads 30 of the retainer 26 to connect the conductor end of the suspension insulator 10 to one or more high voltage power cables.

In accordance with an important feature of the present invention, each connector 24 and 25 includes an elongated, electrically conductive, current bypass sleeve 48 respectively disposed between the fitting 44 and an annularly shaped corona shield 50 and between the fitting 46 and a similar annularly shaped corona shield 52. Each sleeve 48 is fabricated from an electrically conductive material, such as steel, and is disposed about and spaced from the retainer 26 to thereby provide an electrical current path remotely disposed from the retainer 26, the collets 32 34, 36 and 38 and the compound 40. An air gap 51 is provided between major portions of the sleeve 48 and the retainer 26 to reduce the thermal conductivity therebetween. Alternately, the gap 51 may be filled with a thermally nonconductive material. During electrical current flow due to the external flashover of the insulator 10, the major portion of the current flow is through the sleeve 48 rather than through the retainers 26 to reduce the amount of heating to which the compound 40 would have been subjected in the absence of the sleeve 48 and to thereby maintain the thermal-mechanical stability of the junction between the rod 14 and the connectors 24 and 25.

The corona shield 50 includes an upwardly extending rim 53 for physically locating the sleeve 48 and for providing a good electrical contact between the corona shield 50 and the sleeve 48. The rim 53 physically spaces the sleeve 48 from the retainer 26 to thereby reduce the transfer of heat to the compound 40 resulting from the flow of electrical current upon the external flashover of the suspension insulator 10. Similarly, the corona shield 52 includes an interiorly disposed, radially inwardly projecting shoulder 54 for physically locating the sleeve 48 between the corona shield 52 and the fitting 46. The sleeve 48 of the connector 25 is thus maintained physically spaced from the retainer 26 to reduce the transfer of heat to the compound 40 resulting from the flow of electrical current upon the external flashover of the suspension insulator 10.

In accordance with important aspects of the present invention, a plurality of closed cell, expansion compensation discs 60 are disposed between the corona shield 50 and the nearest shell 16, between adjacent shells 16 and between the shield 52 and the nearest ceramic insulating member, discussed in detail hereinafter, to substantially hermetically seal the interior portions of the suspension insulator 10 and to provide for the volumetric thermal expansions and contractions of the above-mentioned portions of the suspension insulator 10. Each disc 60 is formed from a closed cell, compressible elastomer that remains pliable over an extended temperature range, for example, −50° C. to +50° C. The compensation discs in various specific embodiments are fabricated from ethylene propylene rubber, a silicone elastomer or a fluorosilicone elastomer.

The compensation discs 60 compensate for the thermally induced volumetric expansions and contractions of the various component parts of the suspension insulator 10; namely the filler material 22, the insulating shells 16 and the elongated suspension rod 14. Thus the compensation discs 60 provide a mechanical function to compensate for the various and diverse thermally induced volumetric changes in and between the suspension insulator components in an essentially non-compressible thermal expansion environment at the interfaces of the component parts of the suspension insulator 10.

The compressible material from which the compensation discs 60 are fabricated is required to have a compressibility factor in the range of 25 to 50% to ensure adequate compensation for the aforementiond thermally induced volumetric changes to ensure the integrity of and prevent the destruction of the suspension insulator over extreme temperature ranges, +50° C. to −50° C. for example. In a specific embodiment, the volumetric changes require the compensation discs 60 to have a 25% compressibility factor and a 50% compressibility factor is utilized to allow an adequate design margin.

Since the compensation discs 60 are part of the suspension insulator assembly 10, the discs 60 are also subject to an electrical stress. The electrical stress is primarily longitudinal appearing across each of the discs due to the operating voltage stress experienced by the suspension insulator 10 under normal operating conditions. The electrical stress across each of the compensation discs 60 varies in relation to the position of the respective compensation discs 60 in the suspension insulator 10; the respective compensation discs closest to the end connectors 24 and 25 being electrically stressed to a greater extent than the compensation discs 60 located near the center of the suspension insulator 10. These electrical stresses appearing across the compensation discs during the operating conditions of the suspension insulator 10 include the continuous stress experienced during normal operation and further the stress experienced during transient over-voltage conditions.

Thus, in accordance with important aspects of the present invention, the compensation discs 60 must satisfy both the mechanical and electrical requirements described hereinbefore. To achieve the required compressibility factor of 25 to 50% to accommodate the volumetric changes of the suspension insulator components over the temperature range of −50 to +50° C., the compensation discs 60 are fabricated from a material having a predetermined, closed cell characteristic. The material from which the compensation discs 60 are fabricated includes a predetermined pattern of a large number of gas filled, closed cells. The gas contained within the closed cells is typically $CO_2$ or Nitrogen. In this context, the term closed cell defines the limitation of intercell communication and requires a separation between each of the cells by a defined membrane of the fabrication material. This is in contrast to an open cell structure wherein the cells within the material are interconnected or intercommunicating in a cell to cell fashion.

In accordance with the respective electrical stresses appearing across each of the compensation discs 60, the electrical stress in each of the gas filled, closed cells is disproportionally greater than the stress across the compressible material between the closed cells due to the dielectric constant of the gas filled cells being approximately $\frac{1}{3}$ to $\frac{1}{4}$ that of the elastomeric material of which the discs are fabricated. Thus, during normal continuous voltage operation, ionization of the gas within the closed cells must be prevented. Ionization of the gas within the cells could occur at voltages considerably below the voltage that would result in electrical puncture of the elastomeric material from which the discs are fabricated; that is, the material between the closed cells. Further, to withstand the transient overvoltages that are specified for the suspension insulator 10, the compensation discs 60 are fabricated from a material that includes a predetermined pattern of closed cells capable of withstanding the resultant stress conditions.

To prevent ionization of the gas filled, closed cells within the compensation discs 60, it has been found most advantageous in accordance with partial discharge test data and techniques to select a fabrication material including closed cells having a generally ovate spheroid shape with the major axis of each cell in the assembled compensation discs 60 being oriented in a plane perpendicular to the longitudinal axis of the suspension insulator. This orientation of the cells results in high extinction voltages which are desirable in the subject environment. It has been found that the extinction voltage characteristic of the compensation discs 60 is inversely proportional to the cell length in the longitudinal direction of the suspension insulator 10. Further, the distribution of the cells in the longitudinal direction should be relatively uniform to avoid any low dielectric strength cell to cell paths in the longitudinal direction. This results in a uniform, longitudinal dielectric strength throughout the compensation disc. The capability of the compensation disc to withstand the transient overvoltages experienced by the suspension insulator also requires that the cells within each of the compensation discs 60 be relatively evenly spaced in the longitudinal direction to avoid any low dielectric paths from cell to cell in the longitudinal direction of the insulator 10. This is especially true where the transient overvoltages are of the impulse type which occur when a transmission line incorporating the suspension insulators is struck by lightning; impulse failures generally occur along the low density paths in materials.

In achieving the 25 to 50% compressibility factor for the compensation discs 60, it is thus desirable that the overall cell or void space required for this compressibility be obtained by providing a very large number of relatively small cells as opposed to a few, large sized cells. The cells must be separated from neighboring cells by an electrically adequate membrane of an elastomeric material; i.e., a membrane having a sufficient, electrical puncture strength.

Referring now to FIG. 3, the compensation discs 60 are fabricated from a closed cell, elastomeric material wherein each of the closed cells is an ovate spheroid oriented in a common direction or pattern. Thus a closed cell material is utilized for the compensation discs 60 that exhibits a cell shape and directional characteristic that is most favorable to the electrical stress directions experienced in the suspension insulator 10. That is, the ovate spheroid shaped cells are arranged such that the minor axis of each of the cells is in the longitudinal E field direction of the insulator and the major axis of each cell is arranged in a plane perpendicular to the longitudinal axis of the insulator 10. The preferred fabrication material for the compensation disc 60 is that material exhibiting a compressibility factor 25 to 50%, having the proper cell shape and orientation and exhibiting the shortest cell length in the longitudinal direction in the assembled orientation of the compensation discs 60.

In accordance with the aforementioned characteristics of the compressible fabrication material, the following parameters for a preferred cell geometry have been found to be suitable and are given by way of example and should not be interpreted in a limiting sense: preferred cell size range of 0.06 mm to 0.40 mm; cell major to minor diameter ratio of approximately 1.5.

In selecting appropriate fabrication materials for the compensation discs 60, it has been found that compression molded discs obtained from sheets of stock or slabs is preferable in accordance with the aforementioned principles as opposed to fabricating discs by slicing from an extruded cylinder of bulk stock. Thus in slab or sheet stock, the major axis of each of the ovate spheroid cells is oriented parallel to the surface of the slab while in extruded stock the major axes of the cells are normally parallel to the axis of the cylinder. Typically, this type of material is fabricated in a compression molding operation where various materials are combined that react to form gas bubbles during curing. Under compression, the gas cells are orientated with their major axes parallel to the surface of the sheet stock.

In accordance with further important aspects of the present invention, the compensation discs 60 are compressed during assembly of the suspension insulator 10 to increase the ratio of the major to minor axes. In effect, this reduces the thickness of the cells in the longitudinal or axial direction of the suspension insulator 10. This assembly technique improves the dielectric characteristics of the compensation discs 60 by reducing the mean, free ionization path length within each of the cells and increases the solid elastomeric material to void space ratio. Testing by partial discharge extinction voltage measurements substantiates that the dielectric strength characteristics are increased by the compression of the compensation discs during assembly of the suspension insulator 10. For example, a linear relationship has been found to exist between the increase in the extinction voltage and the percent of compression achieved during assembly. Thus a 5% compression during assembly increases the extinction voltage and thus the dielectric strength of the material from 25 to 30%. Similarly a 15% compression factor during assembly increases the extinction voltage by approximately 75% and the dielectric strength by approximately 100%. This characteristic has been found to be essentially linear in the compression range from 1 to 25%. The approximate dimension of the compensation discs 60 in a specific embodiment are 6 to 7 mm thick and 70 mm in diameter.

In order to improve the mechanical bonding between the various portions of the suspension insulator 10 and to improve the overall rigidity and performance of the suspension insulator 10 over an extended temperature range, an elastomeric adhesive coating is applied to all of the interfaces between adjacent or abutting portions of the suspension insulator 10. For example, the elastomeric adhesive coating is applied to the exterior of the rod 14 in the region of the shells 16 and to the interior and mating surfaces of the shells 16, the corona shields 50 and 52 and the discs 60.

A single suspension insulator 10 may support a plurality of mechanically interconnected high voltage power cables suspended from a transmission tower. Alternatively, a pair of suspension insulators 10 (FIG. 2) may be connected in a "V" configuration to support a plurality of high voltage power cables 70, 72, 74 and 76 suspended from a transmission tower. The suspension insulators 10 are joined together by means of their fittings 46 and a union clamp 80 that is secured to a yoke plate 82 that supports the cables 70, 72, 74 and 76 by cable clamps or guides 84 secured to the plate 82.

When a pair of suspension insulators 10 are used in a "V" configuration, the lowermost shells 16 are positioned in close proximity to the cables 70, 72, 74 and 76 resulting in an increase in the electrical stress across the air paths between the lowermost shells 16 and the closest cables 70, 72, 74 and 76. The increased electrical stress reduces the resistance of the suspension insulators 10 to flashover and also increases the possibility of arcing to the lowermost shells 16, thereby giving rise to radio frequency interference.

In accordance with an important feature of the present invention, an additional, elongated, generally cylindrical, shedless, ceramic insulator 90 (FIGS. 1 and 2) is positioned between the shield 52 and the lowermost shell 16 at the conductor end of the suspension insulator 10 to increase the air gap between the cables 70, 72, 74 and 76 and the lowermost shell 16. The increased air gap increases both the voltage required to cause flashover of the suspension insulator 10 and the voltage required to cause arcing to the lowermost shell 16.

Typically, when a pair of suspension insulators 10 were used in a "V" configuration, it was customary to provide so-called corona rings in proximity to the plate 82 to relieve the electrical stresses in the vicinity of the cables 70, 72, 74 and 76 and the suspension insulators 10. These corona rings, the relative positions of which are illustrated by phantom lines 92 and 94 (FIG. 2) are old and well known in the prior art. The use of the insulators 90 in accordance with the principles of the present invention eliminates the need for the corona rings, thereby reducing the cost of the entire suspension assembly.

Obviously, many modifications and variations of the present invention are possible in light of the above teachings. Thus, it is to be understood that, within the scope of the appended claims, the invention may be practiced otherwise than as specifically described.

What is claimed and desired to be secured by Letters Patent of the United States is:

1. A suspension insulator comprising an elongated electrically insulating rod for supporting a load in tension, an end connector affixed to a longitudinal end of said rod, said end connector comprising means mechanically bonding said end connector to said rod, said bonding means comprising a resin compound having bonding properties that change with changes in temperature, and a rigid retainer receiving and retaining said resin compound, an end fitting affixed to said end connector, and means spaced apart from and substantially thermally nonconductive with respect to said retainer for providing a conductive path for current flow due to an external electrical flashover of said suspension insulator and substantially bypassing said retainer to thereby maintain an effective mechanical bond between said end connector and said rod during and subsequent to a flashover, said conductive path providing means comprising an elongate electrically conductive cylinder disposed substantially coextensive with said retainer and in contact with said end fitting substantially along the contact surface of said end fitting and said retainer.

2. A suspension insulator as defined in claim 1, wherein said elongate conductive cylinder comprises a rigid sleeve.

3. A suspension insulator as defined in claim 1 wherein at least a portion of said end fitting is disposed between said retainer and said elongate conductive cylinder.

4. A suspension insulator comprising an elongated electrically insulating rod for supporting a load in tension, an end connector affixed to a longitudinal end of said rod, said end connector comprising means mechanically bonding said end connector to said rod, said bonding means comprising a resin compound having temperature dependent bonding properties, and a rigid retainer receiving and retaining said resin compound, an end fitting affixed to said end connector, and means spaced apart from said retainer and in contact with said end fitting for protecting said resin compound from being heated beyond predetermined desirable limits due to electrical current flow upon an external electrical flashover of said suspension insulator, said protecting means providing an electrical current path that substantially bypasses said retainer to thereby maintain an effective mechanical bond between said end connector and said rod during and subsequent to a flashover, said protecting means comprising an elongate cylinder disposed coextensive with said retainer over a substantial portion of said retainer.

5. A suspension insulator as defined in claim 4 wherein said elongate cylinder comprises a sleeve fabricated from steel.

6. A suspension insulator as defined in claim 4 wherein at least a portion of said end fitting is disposed between said retainer and said elongate cylinder.

7. A suspension insulator as defined in claim 4 further comprising means spaced from said rod ina coaxially aligned condition and adjacent said elongate cylinder for controlling radio frequency interference and for providing a second electrical current path serially electrically disposed with respect to said first-mentioned current path that substantially bypasses said retainer, said controlling and providing means comprising an annular, rigid, conductive, electrical stress distributing member having a rounded, longitudinally extending outer surface.

8. A suspension insulator as defined in claim 7 wherein said annular member includes an upstanding rim protruding upwardly from said annular member and disposed between said elongate cylinder and said retainer.

9. A suspension insulator comprising an elongated electrically insulating rod for supporting a load in tension, an end connector affixed to a longitudinal end of said rod, a plurality of axially aligned, elongated, insulating shells mounted about and serially disposed along the longitudinal axis of said rod, each of said plurality of shells having a centrally disposed elongated bore, means filling substantially all of the spaces between said rod and the internal bores of said plurality of shells, and means disposed between adjacent ones of said shells and said rod for compensating for thermally induced volumetric changes of said shells, said rod and said filling means, said compensating means comprising annularly shaped discs fabricated from a closed cell compressible material.

10. A suspension insulator as defined in claim 9 wherein said compressible material is an ethylene propylene elastomer.

11. A suspension insulator as defined in claim 9 further comprising adhesive means disposed on the interfacing surfaces of said plurality of shells, said discs, said rod and said filling means.

12. A suspension insulator as defined in claim 11 wherein said adhesive means is an elastomeric adhesive.

13. A method of providing integral compensation for thermally induced volumetric changes of the components of a suspension insulator having an elongated electrically insulating rod, an end connector affixed to a longitudinal end of said rod, a plurality of axially aligned, elongated insulating shells mounted about and serially disposed along the longitudinal axis of said rod, each of said plurality of shells having a centrally disposed elongated bore, the method comprising the steps of:

filling substantially all of the spaces between the rod and the internal bores of the plurality of shells with a filling compound, and disposing annularly shaped compensation discs fabricated from a closed cell compressible material between adjacent ones of said shells and said rod for compensating for thermally induced volumetric changes of said shells, said rod and said filling compound.

14. A method as defined in claim 13, further comprising the step of applying an elastomeric adhesive to the interfacing surfaces of said plurality of shells, said discs, said rod and said filling compound.

15. A suspension insulator comprising an elongated electrically insulating rod for supporting a load in tension, an end connector affixed to a longitudinal end of said rod, a plurality of axially aligned, elongated, insulating shells mounted about and serially disposed along the longitudinal axis of said rod, each of said plurality of shells having a centrally disposed elongated bore, means filling substantially all of the spaces between said rod and the internal bores of said plurality of shells, and means disposed between adjacent ones of said shells and said rod for compensating for thermally induced volumetric changes of said shells, said rod and said filling means, said compensating means comprising annularly shaped compensation members fabricated from a closed cell compressible material.

16. A suspension insulator as defined in claim 15 wherein said compensation members are fabricated from a closed cell compressible material wherein the dimension of the cells is at least an order of magnitude smaller than the thickness of said members.

17. A suspension insulator as defined in claim 16 wherein said cells have an approximate ovate spheroid shape.

18. A suspension insulator as defined in claim 17 wherein the minor axis of each of said ovate spheroid shaped cells is substantially aligned with the longitudinal axis of said suspension insulator.

19. A suspension insulator as defined in claim 16 wherein said cells are substantially uniformly distributed in a direction across the thickness of each of said compensation members.

20. A suspension insulator as defined in claim 16 wherein said cells are separated one from another by a membrane of material sufficient to prevent dielectric breakdown of said compensation members during operation of said suspension insulator.

21. A suspension insulator as defined in claim 15 wherein said compensation members are substantially disc shaped and are fabricated from a compression molded foamed elastomer planar sheet.

22. A suspension insulator as defined in claim 21 wherein said compensation members are assembled into said suspension insulator under compression.

* * * * *